United States Patent [19]

Perler

[11] Patent Number: 4,854,457

[45] Date of Patent: Aug. 8, 1989

[54] HYGIENIC TOOTHBRUSH HOLDER

[76] Inventor: Robert Perler, 25 Lockwood Ave., New Rochelle, N.Y. 10801

[21] Appl. No.: 110,411

[22] Filed: Oct. 20, 1987

[51] Int. Cl.[4] ..... A47B 81/02

[52] U.S. Cl. ..... 211/65; 248/113; D6/528; D6/534

[58] Field of Search ..... 248/113, 110, 111, 112, 248/205.3; 211/65, 89, 70.6; D6/528, 529, 530, 531, 534

[56] References Cited

U.S. PATENT DOCUMENTS

| | | | |
|---|---|---|---|
| 1,530,180 | 3/1925 | Holmes | 211/65 |
| 1,800,151 | 4/1931 | Pearson | 211/65 |
| 1,800,855 | 4/1931 | Bostrom | 211/65 |
| 2,472,058 | 6/1949 | Artley | D6/530 X |
| 2,744,635 | 5/1956 | Hiss | 211/65 |
| 2,947,412 | 8/1960 | Tupper | 211/65 X |
| 3,002,630 | 10/1961 | Heisser | 211/65 |
| 3,531,072 | 9/1970 | Lindquist | 211/65 X |
| 3,946,877 | 3/1976 | Galicia | 211/65 |
| 4,100,684 | 7/1978 | Berger | 248/205.3 X |
| 4,605,292 | 8/1986 | McIntosh | 248/205.3 X |

FOREIGN PATENT DOCUMENTS

| | | | |
|---|---|---|---|
| 1947393 | 4/1971 | Fed. Rep. of Germany | 248/205.3 |
| 2447907 | 4/1976 | Fed. Rep. of Germany | 248/205.3 |

*Primary Examiner*—Ramon O. Ramirez
*Attorney, Agent, or Firm*—Handal & Morofsky

[57] ABSTRACT

The present invention provides a structure 10 for holding multiple toothbrushes 42, 44, 46, 48 in such a way as to hold the toothbrushes 42, 44, 46, 68 by the handle, rather than resting on the bristles as in conventional designs, and position the toothbrushes so they can properly drain over different areas without contamination from other toothbrushes and in a direction which promotes rapid evaporation of residue. The present invention also provides a structure 10 for positioning the toothbrushes directly above a sink for proper drainage into the sink.

9 Claims, 1 Drawing Sheet

HYGIENIC TOOTHBRUSH HOLDER

TECHNICAL FIELD

The invention relates to a device for providing a hygienic toothbrush holder and means of attaching the same to a wall.

BACKGROUND OF THE INVENTION

Traditionally, toothbrush holders have consisted of a glazed ceramic plate with vertical holes incorporated in it. This plate is horizontally oriented and attached to the wall, usually above the bathroom sink. The toothbrushes are inserted into the holes in the plate and are prevented from slipping through the hole by the brush's bristles. This constant resting of the toothbrush on its bristles has the tendency to deform the shape of the bristles while maintaining them in a damp environment, ultimately destroying the toothbrush. Even more importantly, because of the nature of the apparatus, the toothbrushes do not drain properly and after use saliva, toothpaste, and water are allowed to settle in a common pool which the brushes sit in. This produces a breeding ground for bacteria and cross-infection between household members. Alternatively, toothbrushes are placed in a cup, resulting in even more insufficient drainage and the introduction of unnecessary clutter and unsightly appearance to the bathroom sink area.

DISCLOSURE OF THE INVENTION

The invention as claimed is intended to provide a remedy. It solves the problem of providing a convenient, efficient means for properly draining toothbrushes after use while maintaining effective and relatively simple construction. As mentioned above, among the major disadvantages of traditional toothbrush holders are their inherent tendency to distort the original desired shape of the toothbrush's bristles and their lack of proper drainage. To relieve these unwanted attributes, the present invention is designed to hold the toothbrushes in such a way that the bristles are allowed to properly drain and are relieved of any distorting forces.

To achieve its intended purpose, the present invention incorporates a unique method of holding toothbrushes. Its construction is of rigid plastic, either clear or colored, in either one or multiple pieces. In the preferred embodiment, the first piece is mounted to the wall via either predrilled screw holes or an adhesive strip. The second piece consists of a rigid plastic plate with prongs made of semirigid plastic integrally attached to the plate. These prongs are staggered in the vertical and/or horizontal plane(s). These prongs are made of a semirigid plastic and configured to apply a certain spring force to a brush held therebetween. The prongs clamp the toothbrushes by the toothbrush handle and are oriented in such a way as to hold the long axis of the toothbrush in the horizontal plane with the bristles pointed down. Thus the bristles are allowed to completely drain and are not subjected to any distorting force. Because the prongs are staggered on the plate and thus the toothbrushes are staggered, multiple toothbrushes can be held without any contamination from the drainage of the brushes above it.

Because of the multiple piece construction of the preferred embodiment of the present invention, the toothbrush holder portion can be removed from the base and thoroughly cleaned, either by hand or in the dishwasher.

BRIEF DESCRIPTION OF THE DRAWINGS

One way of carrying out the invention is described in detail below with reference to drawings which illustrate only one specific embodiment in which.

DETAILED DESCRIPTION OF THE DRAWINGS

Figure 1:
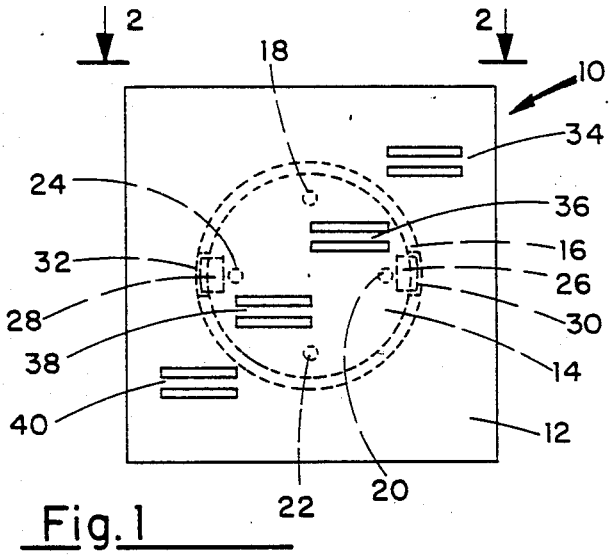
FIG. 1 is a front view of the preferred embodiment of the present invention.
Figure 3:
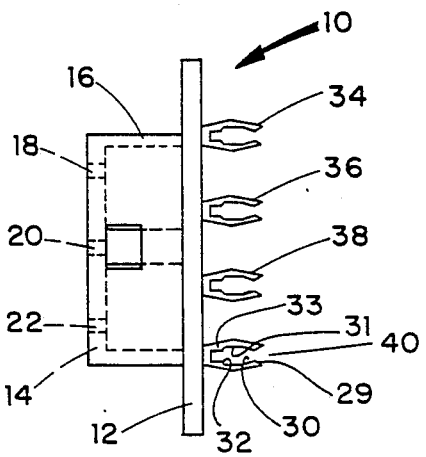
FIG. 3 is a side view of the preferred embodiment of the present invention along lines 3—3 of FIG. 2.
Figure 2:
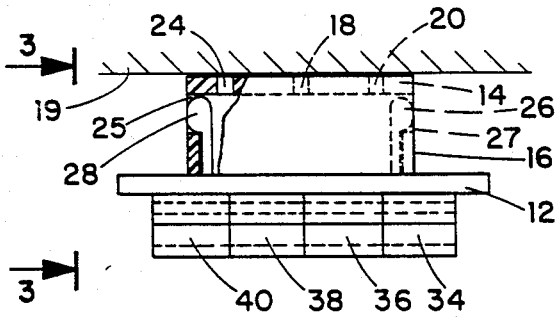
FIG. 2 is a top view of the preferred embodiment of the present invention along lines 2—2 of FIG. 1.
Figure 4:
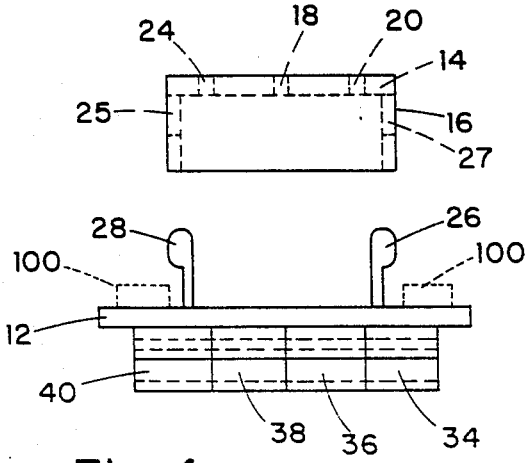
FIG. 4 is an exploded view similar to FIG. 2 of the preferred embodiment of the present invention.

As illustrated in FIG. 1, a hygienic toothbrush holder 10 constructed in accordance with the present invention comprises a face plate 12, separatably attached to a base 14 as illustrated in FIGS. 2–3. Base 14 has tubular sidewalls 16 and is mounted to a wall 19 via predrilled screw holes 18, 20, 22, 24. Face plate 12 is separatably attached to the base 14 via face plate attaching prongs 26 and 28. Separation of base 14 and plate 12 is illustrated in FIG. 4. Face plate attaching prongs 26, 28 are integrally formed with the face plate 12 and mate with the face plate attaching prong cutouts 25, 27 located on tubular side walls 46 of the base 14. Thus face plate 12 can be separated from base 14 for ease of cleaning. Gripping structure formed by entry guide surfaces 29, retention supports 30, gripping surfaces 31 back supports 32 and bases 33 define toothbrush holding clips 34, 36, 38, and 40 attached to the front surface of the face plate 12.

Clips 34–40 are made up of resilient plastic and may be formed integrally with face plate 12 or molded separately and inserted and glued into face plate 12.

Figure 5:
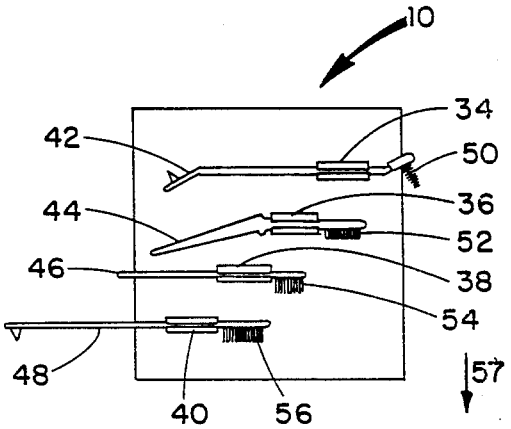
FIG. 5 is a front view of the preferred embodiment of the present invention in use.

As shown in FIG. 5, the toothbrush holding clips 34, 36, 38, and 40 are positioned and oriented in such a way as to hold a number of dental utensils 42 and/or toothbrushes 44, 46, and 48 by the handle so that dental utensil 42 and toothbrushes 44, 46, and 48 are oriented with their long axis horizontal and bristles 50, 52, 54, and 56 staggered and facing down. Thus dental utensil 42 and/or toothbrushes 44, 46, and 48 are allowed to drain properly (that is in the direction of arrow 57) without any bristle distorting force and minimal chance of contamination from toothbrushes draining above it. Because of the removable nature of the face plate 12 from the base 14, the face plate 12 can be removed and washed either by hand or in a dishwasher.

Figure 6:
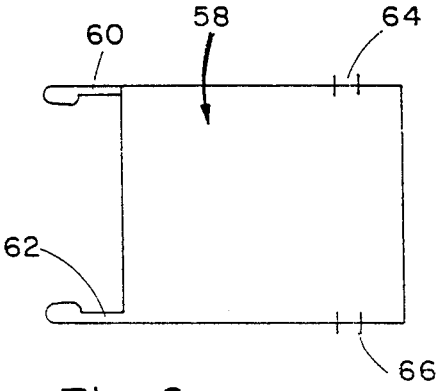
FIG. 6 is a side view of the extension tube of the preferred embodiment of the present invention.

As illustrated by FIG. 6, an extension tube 58 can be used to extend the position of the toothbrush holder 10 so that the toothbrushes drain into the sink. Extension tube 58 has extension tube attaching prongs 60 and 62 for attaching the extension tube 58 to the base 14. Face plate attaching prong cutouts 64 and 66 mate with face plate attaching prongs 26, 28 of the extension tube 58 in a similar manner as with the attachment of the face plate 12 to the base 14. Thus the extension tube 58 positions the face plate 12 over the sink and for drainage into the sink.

While an illustrative embodiment of the invention has been described, it is of course understood that various modifications will be obvious to those of ordinary skill in the art. As an alternative, plate 12 may be directly secured to the wall of the bathroom by the use of double stick adhesive foam tape 100 as shown in phantom lines in FIG. 4. In such event one could dispose with base 14 and prongs 26–28. Such changes and modifications are within the scope of the invention which is limited and defined only be the appended claims.

I claim:

1. A toothbrush holder, comprising:

(a) first holding means for supporting a respective dental utensil with bristles mounted vertical to the length of the utensil in a utensil base, said utensil being supported in a bristles down orientation whereby said bristles are oriented to drain liquid away from said utensil base;

(b) base means for supporting said first holding means;

(c) securing means for mounting said base means to a surface, said securing means comprising:

(i) attachment means for attaching to a wall;

(ii) engagement means secured to said attachment means; and (iii) mating engagement means secured to said base means and mating with said engagement means; and (d) second holding means for supporting a second dental utensil in bristles down orientation, said first and second holding means being positioned to allow said bristles to drain over different areas when a dental utensil is in each of said first and second holding means, said first and second holding means being resilient clips, each of said clips comprising a pair of resilient arms spaced from each other a distance substantially equal to the thickness of the shank of the handle of a dental utensil to be held, the extremities of said arms being closer to each other than said thickness, (e) wherein said engagement means is a hole and said mating engagement means is a resiliently mounted stud.

2. A toothbrush holder as in claim 1, further comprising;

(f) at least two additional holding means for supporting additional dental utensils in a bristles down orientation, said plurality of means being positioned to allow said bristles to drain over different areas.

3. A toothbrush holder as in claim 1, wherein said securing means further includes a double stick tape.

4. A toothbrush holder as in claim 1 further comprising an extension tube, said extension tube terminated on one end by a suitable one of said engagement means or said mating engagement means for attachment and positioning of said extension tube between said attachment means and said base.

5. A toothbrush holder as in claim 4 wherein all parts are plastic.

6. A toothbrush holder as in claim 1 wherein all parts are plastic.

7. A toothbrush holder, comprising:

(a) first holding means for supporting a respective dental utensil with bristles mounted in a utensil base, said utensil being supported in a bristles down orientation whereby said bristles are oriented to drain liquid away from said utensil base;

(b) base means for supporting said first holding means;

(c) securing means for mounting said base means to a surface, said securing means comprising:

(i) attachment means for attaching to a wall;

(ii) engagement means secured to said attachment means; and (iii) mating engagement means secured to said base means and mating with said engagement means;

(d) second holding means for supporting a second dental utensil in bristles down orientation, said first and second holding means being positioned to allow said bristles to drain over different areas when a dental utensil is in each of said first and second holding means; and (e) an extension tube, said extension tube terminated on one end by a suitable one of said engagement means or said mating engagement means for attachment and positioning of said extension tube between said attachment means and said base.

8. A toothbrush holder, comprising:

(a) first holding means for supporting a respective dental utensil with bristles mounted in a utensil base, said utensil being supported in a bristles down orientation whereby said bristles are oriented to drain liquid away from said utensil base;

(b) base means for supporting said first holding means;

(c) securing means for mounting said base means to a surface; and (d) an extension member, said extension member terminated on one end by attachment means for attaching to a wall and terminated on the other end by mating engagement means for engaging said securing means on said base for attachment and positioning of said extension member between said attachment means and said base.

9. A toothbrush holder as in claim 1 wherein said clip further comprises a pair of tapered guide surfaces for guiding said shank between said extremities.

* * * * *